United States Patent [19]

May

[11] Patent Number: 4,691,611

[45] Date of Patent: Sep. 8, 1987

[54] ELECTRONIC PERCUSSION INSTRUMENT

[76] Inventor: Gordon H. May, 3261 Woodleigh La., Cameron Park, Calif. 95682

[21] Appl. No.: 785,764

[22] Filed: Oct. 9, 1985

[51] Int. Cl.[4] ..... G10G 5/00

[52] U.S. Cl. ..... 84/421; 84/DIG. 3; 84/DIG. 12

[58] Field of Search ..... 84/1.04, DIG. 12, 1.01, 84/DIG. 3, 421; 248/181, 177, 460

[56] References Cited

U.S. PATENT DOCUMENTS 3,659,032 3/1972 May ..... 84/1.04

4,545,276 10/1985 Curletto ..... 84/1.01

*Primary Examiner*—A. T. Grimley

*Assistant Examiner*—David S. Warren

*Attorney, Agent, or Firm*—Gerald L. Moore

[57] ABSTRACT

A percussion instrument comprising a base (10) supporting a plurality of percussion heads (11, 12, 13 and 14) on standards (25). The standards are each adjustable lengthwise and fixed to the base by mounts (26) and to the percussion heads by mounts (54) such that the positions of the heads can be set once and thereafter will be automatically determined by the preset mounts and standards.

1 Claim, 3 Drawing Figures

ELECTRONIC PERCUSSION INSTRUMENT

FIELD OF THE INVENTION

This invention relates to percussion instruments of the type including one or more percussion heads mounted on stands around a seat on which the player can sit and strike the heads.

BACKGROUND OF THE INVENTION

Because of the very nature of the business, musical bands must move frequently from location to location. One of the most difficult instruments to transport is the percussion section because the components are both fragile and bulky. Stands of various types and sizes must be provided for each of the percussion heads as well as a seat for the musician. This variety of equipment makes the transport of the instrument very difficult.

Not only is it difficult to transport the instrument, but the set-up is also a major task. Unlike all string and wind instruments, the percussion instrument, due to its many individual components, presently requires that each element be arranged for height and attitude each time the musician performs. Additionally, when electronics are employed, the electrical connections must be made with each percussion head for connecting a conductor leading to an amplifier which feeds an amplified signal to sound speakers for radiating the percussion sound. Naturally, the electrical connections must be disconnected and reconnected with each move.

It is the purpose of this invention to provide n improved percussion instrument which integrates mechanics with electronics and further provides set-up memory to greatly simplify setting up, breaking down, and moving.

SUMMARY OF THE INVENTION

A percussion instrument comprising a base forming an internal compartment and including a plurality of sockets in the top surface for receiving stands, each supporting one of the percussion heads at a preselected height. The sockets can be preset to receive and hold the stands at a predetermined attitude and each includes an electrical connector that interfits with a cooperating connector in the stands to transmit an electrical signal from the percussion head to an amplifier located in the base. The speakers incorporated in the base radiate the amplified sound (large speakers are packaged separately).

DESCRIPTION OF THE INVENTION

Figure 1:
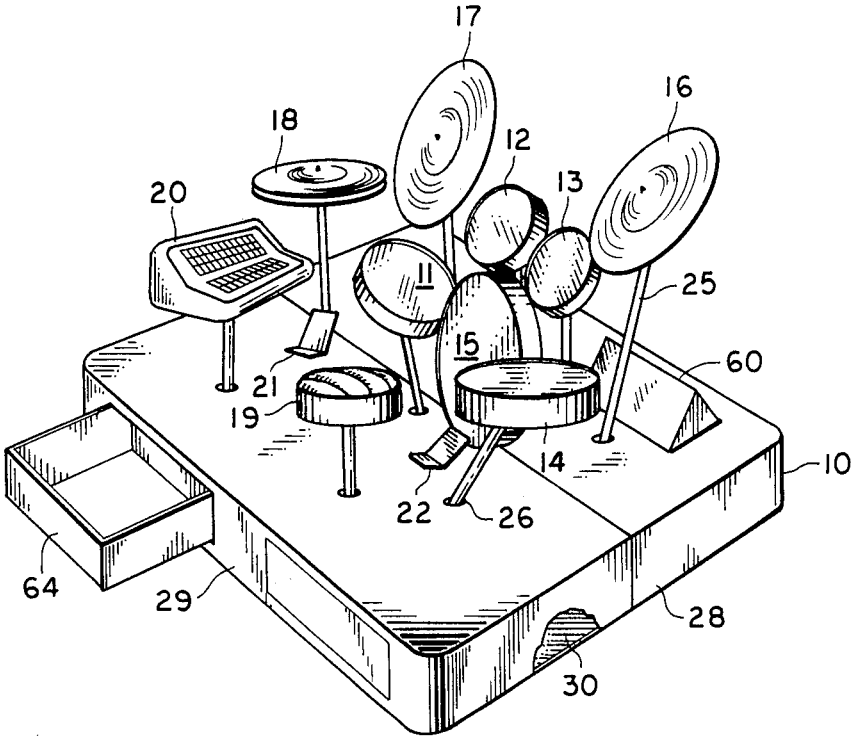
FIG. 1 is a perspective view of an assembled percussion instrument incorporating the subject invention.

In FIG. 1 is shown a percussion instrument comprising a base 10 from which is supported a plurality of percussion devices such as snare drum 11, toms 12, 13 and 14, and a base drum 15. Also cymbals 16, 17, and hi-hat 18 are mounted on the base. A seat 19 is provided for the musician.

While not mandatory, the percussion instrument can be of the type described in U.S. Pat. No. 3,659,032, Percussion Instrument, issued on Apr. 25, 1972 with the same inventor as this application. As with any electronic instrument there is required a control console 20 and various switches, etc. such as the foot pedals 21 and 22 which allow the musician to control and regulate the instrument. Supporting the console and each of the percussion heads is a stand or standard 25 extending down to the top surface 27 of the base. The stand usually comprises a tube or other such elongated member which attaches to the percussion head at one end and the base top surface at the other. The base top surface is supported by sidewalls 28 and endwalls 29 fixed to a bottom wall 30.

As pointed out before, the stands all must be grouped around the player's seat and must be positioned so as to tilt the percussion head at a precise angle so the player can strike each with ease. Percussion instruments are played very frequently by merely striking the stick in an area known to be occupied by a percussion head without actually viewing the percussion head. For this reason, positioning and height are critical and must be repeated with each set-up so that the playing of the instrument remains exactly the same.

Figure 3:
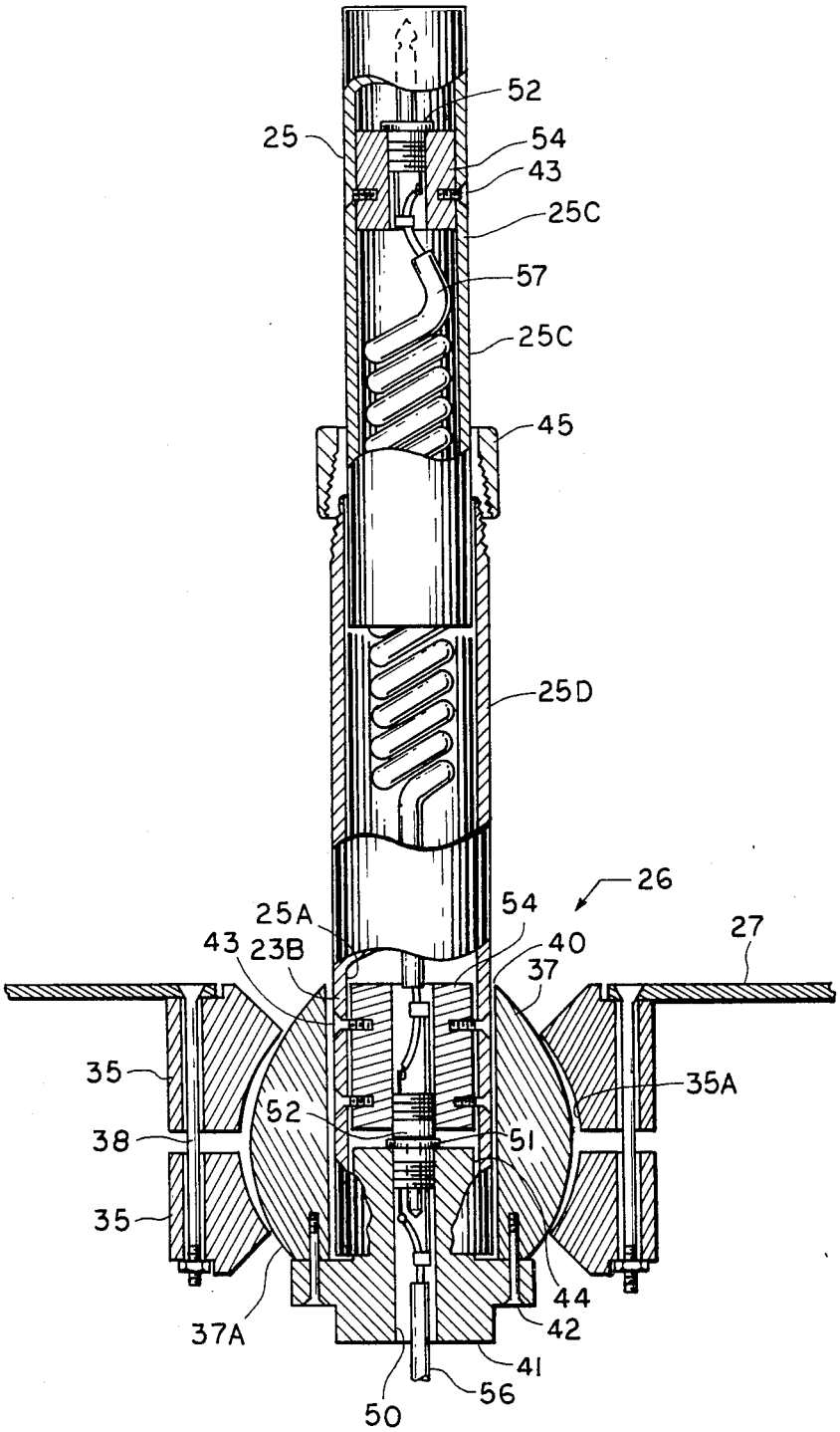
FIG. 3 shows in enlarged cross-sectional detail the socket and a portion of the stand for supporting a percussion head.

The mounts or sockets 26 along with a section of the stand are shown in englarged detail in FIG. 3 and comprise a first semicircle retainer 35 fixed to the top wall 27 of the base. A second semicircle retainer 35 identical to the first but inverted in position cooperates with the first semicircle retainer to hold an inner-spherical support 37 such that the inner support can be rotated for changing the attitude of the stand 25 relative to the base top surface 27. By tightening the screws 38, positioned around the semicircle retainer halves 35, the retainers can be caused to squeeze together thereby bringing the inner surfaces 35*a* into close engagement with outer surface 37*a* of the spherical support and hold it in place. In this manner, by adjusting and then tightening the socket to change the attitude of the stand, this attitude is preset and never changes unless the screws 38 are again loosened. Thus, each time the stand is replaced in the socket, it is automatically adjusted for attitude so as to position the percussion head at the same location and attitude each time.

For mounting each stand, the spherical support 37 includes a center opening 40 closed at the bottom end by an adapter 41 held in place by retaining screws 42. The adapter includes an outer surface 44 which closely fits into the center opening 25*a* of the stand. Thus, the outer surface 25*b* of the stand fits within the spherical support 37 and over the adapter 41 to closely hold the stand in place. The adapter includes a center opening 50 in which is mounted a female jack 51 for receiving a cooperating male jack 52 held in a mount 54 retained in position by screws 43, within the hollow stand. Thus, as the stand is inserted into the support 37, the male jack interfits within the female jack 51 to form an electrical circuit between the conductor 56 extending upward from the base and a conductor 57 leading downward from the stand. The top of the stand also supports a similar smaller mount 54 and a jack 52 in the same manner just described which mount and jack interfit with a similar socket mount 26 fixed to the lower surface of each percusion head so that the percussion head can be disconnected from the stand for transport and storage. Additionally, such a connection allows the percussion head to be adjusted in attitude and clamped in a manner to permit permanent pre-selection of the percussion head positioning. Thus the mount and jack combination allow both the mechanical and electrical connection to be made simultaneously for ease of setting up or taking down the drum stand.

For adjusting the height of the percussion head, each stand is made of sections 25*c* and 25*d* which telescope together. A nut 45 threaded onto the top of the section 25*d* allows clamping of the section 25*c* within the section 25*d*. Thus, once the height of the stand is adjusted, the tightening of the nut preselects the height and need never be changed unless desired. Additionally, suitable markings are provided on stands 25 and sockets 26 to insure that the preselected stand height interfits with its present socket. The conductor 57 can be coiled to accomodate the lengthening and shortening of the stand. As described in the foregoing paragraphs, the height preselect of the stands 25 in conjunction with the attitude preset of sockets 26 create a unique set-up memory. Thus, with this integrated system, the musician merely removes his equipment from ready storage and interfits the heads and stands to complete the precise instrument arrangement for a performance.

Figure 2:
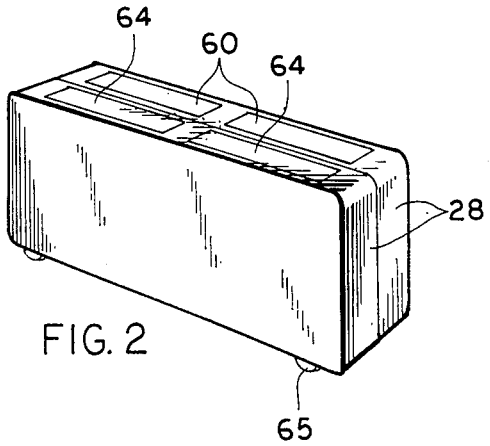
FIG. 2 shows the percussion instrument disassembled and reassembled for transport.

While the percussion devices can be standard and non-electronic types and still function in the base and stand combination for preselected adjustment of positioning, the invention envisions the use of the concept disclosed in the previously identified patent wherein the base includes circuit means (not shown) and one or more speakers 60 (FIG. 2) for the amplification and radiation of the ground generated in the percussion heads and cymbals. Additionally, the base can be formed of two sections 10*a* and 10*b* (FIG. 2) connected by hinges (not shown) such that after removal of the percussion devices, stands, seat, and control console from the sockets 26 the base can be folded to the configuration shown in FIG. 2. By opening drawers 64 (FIG. 1) in the endwalls 29 (FIG. 1) of the base, the percussion devices, etc., can be stored within the base for security and transport. Additionally, rollers 65 (FIG. 2) can be mounted on the base for easy rolling across the floor.

Thus, there has been described a self-contained and easily transported percussion instrument which once adjusted, can be set-up each time with precision location of the percussion heads.

I claim:

1. A percussion instrument comprising:

a base forming internally a compartment;

a plurality of percussion heads which, when struck, will generate percussion sounds;

a head stand for each percussion head comprising;

an elongated standard for each percussion head;

a socket fixed to said base and each said percussion head for attachment of a standard to each head and the base to support the head above said base;

means to adjust and permanently set the length of said standard; and means to adjust and permanently set the angle of each socket so as to adjust the angle of the standard relative to said base and the attached percussion head thereby to allow the percussion instrument to be assembled and adjusted once and to provide memory for allowing the instrument to be set up the same way each time it is disassembled.

* * * * *